United States Patent [19]

Dreyer et al.

[11] 4,062,678

[45] * Dec. 13, 1977

[54] POWDER METALLURGY COMPACTS AND PRODUCTS OF HIGH PERFORMANCE ALLOYS

[75] Inventors: Dennis G. Dreyer, Kokomo; Edward M. Foley, Russiaville; Herbert E. Rogers, Jr., Sharpsville, all of Ind.

[73] Assignee: Cabot Corporation, Kokomo, Ind.

[ * ] Notice: The portion of the term of this patent subsequent to Nov. 5, 1991, has been disclaimed.

[21] Appl. No.: 688,013

[22] Filed: May 19, 1976

Related U.S. Application Data

[60] Division of Ser. No. 443,091, Jan. 17, 1974, which is a continuation-in-part of Ser. No. 323,502, Jan. 15, 1973, Pat. No. 3,846,126.

[51] Int. Cl.[2] ..... B22F 3/00

[52] U.S. Cl. ..... 75/228; 428/546; 428/577; 75/211; 75/213

[58] Field of Search ..... 29/182, 182.5; 75/200, 75/213, 211

[56] References Cited

U.S. PATENT DOCUMENTS

| | | | |
|---|---|---|---|
| 2,857,270 | 10/1958 | Brundin | 75/213 |
| 3,615,381 | 10/1971 | Hammond | 75/213 |
| 3,639,179 | 2/1972 | Reichman et al. | 75/171 |
| 3,671,230 | 6/1972 | Smythe et al. | 75/213 |
| 3,846,126 | 11/1974 | Foley et al. | 75/211 |

*Primary Examiner*—Brooks H. Hunt

*Attorney, Agent, or Firm*—Jack Schuman; Joseph J. Phillips

[57] ABSTRACT

A powder metallurgy compact and a sintered product is provided from high performance alloys difficult to compact and/or sinter. The green compact comprises a mixture of the alloy powder, which, as a result of blending and extruding is coated with a film of a solid organic binder, and consolidated to discrete bodies of an intermediate density. The green compacts are sintered to produce a final solid product.

1 Claim, No Drawings

POWDER METALLURGY COMPACTS AND PRODUCTS OF HIGH PERFORMANCE ALLOYS

This application is a division of our copending application Ser. No. 443,091, filed Jan. 17, 1974, which was in turn a continuation-in-part of our application Ser. No. 323,502, filed Jan. 15, 1973 now U.S. Pat. No. 3,846,126, issued Nov. 5, 1974.

This invention relates to green compacts and sintered products of powdered hard metal alloys. It is more particularly concerned with articles of high performance metal alloys.

The alloys with which this invention is concerned are high performance cobalt-base, nickel-base, and iron-base chromium-containing alloys resistant to wear, heat and corrosion. These alloys either are not workable or are worked with difficulty, and are commonly produced as castings, which may be ground or machined where necessary. Many small articles made from high performance alloys, such as thread guides for textile mills, valve seat inserts, and the like, are tedious and expensive to cast in the quantities that are required. Attempts have been made to produce such articles by powder metallurgical process, such as by slip casting or pressing the articles to shape from fine powders, and then sintering them. However, such processes, which have proved satisfactory and economical for many alloys, have turned out to be difficult and expensive to adapt to alloys as hard as the high performance alloys here concerned.

One difficulty is that of achieving the desired high density in the finished article. It has been generally considered that the powder particles should be of spherical configuration and of a random size distribution over a rather wide range of sizes to provide optimum packing density and so facilitate subsequent densification. In U.S. Pat. No. 3,639,179 of Steven Reichman et al. of Feb. 1, 1972, Method of Making Large Grain Sized Superalloys, the patentees recommend a size range of about 150 microns to about 10 microns. We have found, however, that a number of high performance alloy powders when compacted in this way can be sintered only in a very narrow range of temperatures, or in some cases not at all.

Experiements have indicated that the sintering of metal powders, in general, can be improved by decreasing the particle size of the powder to −325 mesh or less. If this is done by screening the powder through a fine screen only a fraction of the powder is used, which is not economical. In powder atomized from an alloy melt, which is a type of powder widely used in powder metallurgy, only 25% to 35% of the powder is −325 mesh, for example. We attempted to salvage overscreen powder by grinding it to finer size and found that sinterable powder of the high performance alloys here concerned could be obtained. In many instances, however, this powder was deficient in coherence under pressure, unless it was ground to a considerably smaller particle size than was necessary for sintering.

In the production of articles from iron powder or the powder of ordinary alloys it is conventional to compress the powder into green compacts, so-called, in the shape of the desired article, and then transfer those compacts to a furnace where they are sintered. Those compacts must keep their shape until the particles are bonded by the sintering operation. The stresses which green compacts must withstand depend, among other considerations, on the shape of the compact and its dimensional tolerances. The bulk density of compacts ranges from about 50% of cast density to about 70% where high compacting pressures are employed. As the density of the sintered article is generally required to be 95% of cast density or better, all compacts shrink from about 25% to as much as 40% or more during sintering. Where the sintered compact must meet close dimensional tolerances the compacts are constrained during sintering. In the manufacture of valve seat inserts which must be made to close inside diameter tolerances, for example, the green compacts are slipped over mandrels and sintered in that position. If the cohesion between the powder articles is insufficient the compacts will crack.

The average particle size required for effective compacting, in the worst case, was found to be less than about 5 microns, and the grinding time necessary for such powder was measured in days. This, of course, considerably increased its cost. Moreover, the greatly increased surface area of the very fine powder and the length of time required for its grinding facilitated oxidation of the powder so that, in spite of all precautions, its oxygen content was much greater than that of atomized powder. This high oxygen content is undesirable for several reasons, one overriding reason being that it narrows the sintering range of the powder. Thus, the sinterable powders were not compactible for many of the alloys, and the compactible powders were, effectively, not sinterable.

It is an object of our invention, therefore, to provide a green compact as well as sintered articles of high performance alloys by powder metallurgy which economically utilizes atomized powders. Another object is to provide such a green compact having a broader range of sintering temperatures. Another object is to provide a green compact which tolerates the use of particles of larger screen size than prior known processes. It is still another object to provide green compacts and sintered articles of high performance alloys not sinterable by presently known powder metallurgy process. Other objects of our invention will appear from the description thereof which follows.

We have found that compactability of high performance alloy powders is greatly improved by coating the particles with a binder in a way to be described, and that the coarse fraction of the powder can be reduced to a particle size suitable for sintering in a relatively brief grinding operation which does not increase the oxygen content of the powder to unacceptable levels.

Our invention to be described is adapted to utilize the full size range of atomized melts of many high performance alloys if maximum density in the resulting article is desired. It is also adapted to high performance alloys which by conventional processes are unsinterable or marginally sinterable. It comprehends the use of a relatively coarse fraction of an atomized melt, or the entire product, which has been reduced to a size which is not accompanied by unacceptable oxidation, the dry blending of this powder with a binder, and the mixing of that blend with a solvent for the binder to produce a plastic mass, the consolidation of this mass to discrete bodies of an intermediate density, the drying and crushing of those bodies and screening of the resulting agglomerates to about −100 mesh size, the pressing of the agglomerates into green compacts which hold their shape, the transfer of those compacts to a furnace, and the sintering of those compacts.

Compositions of a number of alloys for which our process is suitable are listed in the accompanying Table.

Compositions of Typical Alloys In Weight Percent Alloying Elements

| Alloy | Co | Ni | Si | Fe | Mn | Cr | Mo | W | C | V | B | P | S | Ta + Cb |
|---|---|---|---|---|---|---|---|---|---|---|---|---|---|---|
| 1 | Bal. | 3.0* | 1.0* | 3.0* | 1.0* | 29.0 | — | 11.0 | 2.00. | 1.0* | — | — | | |
| | | | | | | | | | — | | | | | |
| | | | | | | 33.0 | | 14.0 | 2.70 | | | | | |
| 2 | Bal. | 3.0* | 1.5* | 3.0* | 1.0* | 27.0 | 1.50* | 3.5 | 0.90 | — | 1.0* | — | — | |
| | | | | | | 31.0 | | 5.5 | 1.40 | | | | | |
| 3 | Bal. | 9.5 | 1.0* | 2.0* | 1.0* | 24.5 | — | 7.0 | 0.45 | — | — | 0.04* | 0.04* | |
| | | 11.5 | | | | 26.5 | | 8.0 | 0.55 | | | | | |
| 4 | Bal. | 3.0* | 1.0* | 5.0* | 1.0* | 24.0 | — | 13.0 | 3.00 | — | 1.0* | — | — | |
| | | | | | | 28.0 | | 15.0 | 3.50 | | | | | |
| 5 | Bal. | 2.5* | 1.0* | 3.0* | 1.0* | 31.0 | — | 16.0 | 2.20 | — | 1.0* | — | — | |
| | | | | | | 34.0 | | 19.0 | 2.70 | | | | | |
| 6 | Bal. | 2.0 | 1.0* | 2.5* | 1.0* | 28.0 | 0.8* | 17.0 | 1.70 | 3.70 | 0.7 | — | — | |
| | | 5.0 | | | | 32.0 | | 20.0 | 2.20 | 4.70 | 1.5 | | | |
| 7 | 9.0 | Bal. | 1.0* | 11.5 | 0.75* | 25.0 | 9.0 | 9.0 | 1.30 | — | 1.0* | 0.04* | 0.03* | |
| | 11.0 | | | 13.5 | | 27.0 | 11.0 | 11.0 | 1.50 | | | | | |
| 8 | — | — | 0.5 | Bal. | 0.5* | 15.5 | 14.5 | — | 2.90 | 1.65 | — | — | — | |
| | | | 1.5 | | | 18.5 | 17.5 | | 3.40 | 2.10 | | | | |
| Alloy | Co | Ni | Si | Fe | Mn | Cr | Mo | W | C | V | B | P | S | Ta + Cb |
| 9 | Bal. | 3.0* | 1.0* | 3.0* | 1.0* | 29.5 | — | 9.5 | 1.5 | — | 1.0* | — | — | — |
| | | | | | | 32.5 | | 11.5 | 2.1 | | | | | |
| 10 | 45 | — | 1.0* | 2.0 | 1.0 | 27.0 | — | 14.0 | 2.0 | — | 1.0* | — | — | 2.0 |
| | 50 | | | 5.0 | 3.0 | 32.0 | | 19.0 | 4.0 | | | | | |
| 11 | 9.0 | Bal. | 1.0* | 11.5 | 0.75* | 25.0 | 9.0 | 9.0 | 1.65 | — | 1.0* | — | — | — |
| | 11.0 | | | 13.5 | | 27.0 | 11.0 | 11.0 | 5.0 | | | | | |
| 12 | Bal. | 2.0* | 1.75* | 3.0* | 1.0* | 26.0 | — | 18.0 | 1.35 | 0.75 | 1.0* | — | — | — |
| | | | | | | 30.0 | | 24.0 | 5.0 | 1.25 | | | | |
| 13 | Bal. | 4.0 | 1.0* | 3.0* | 1.0* | 26.0 | — | 18.0 | 0.7 | 0.75 | 1.0* | — | — | — |
| | | 6.0 | | | | 30.0 | | 21.0 | 1.0 | 1.25 | | | | |

*Maximum Balance includes incidental impurities

The alloy powder which we employ is preferably produced by the atomization of a melt of the desired composition. This melt is heated to a temperature of 200° F. or so above its fusion temperature in a crucible. Preferably, this melting is carried out in vacuum or under a blanket of inert gas such as argon. The melt is then poured into a preheated refractory tundish which is formed with a small diameter nozzle in the bottom through which the stream of metal flows into an atomizing chamber. The stream emerging from the nozzle is broken up into fine particles by a high-pressure jet of inert gas, or of water, which makes contact with the molten stream just below the nozzle. The particles or droplets are almost instantaneously quenched by the atomizing fluid and fall into a reservoir in the bottom of the atomizing chamber. Only a fraction is used which passes through a 30 mesh screen. These particles are approximately spherical in shape and about 25% to 35% of the particles are −325 mesh. A 325 mesh screen will pass particles the greatest dimension of which is 44 microns.

We prefer to use polyvinyl alcohol as a binder for our powder, but other solid binders which are known to the art are employed. Examples are camphor, paradichlorobenzene, Chloroacetic acid, napthaline, benzoic acid, phthalic anhydride, glycerine, Acrowax C, which is a proprietary compound, the ethylene oxide polymers sold as Carbowax, synthetic gums such as acrylamide, and metal stearates. The solvent for the binder must be appropriately chosen. Water is satisfactory for water-soluble binders.

The blending of the powder and binder particles is accomplished in any suitable mixing apparatus. The amount of binder is not critical but should be within the range 2% to 5% for best efficiency. Extrusion of the plastic or putty-like blend of particles, binder and solvent is the most convenient way of consolidating the plastic mixture into agglomerates, but other methods, such as roll briquetting, may be employed.

The extrusions are then dried, crushed in a roller crusher, hammer mill or the like, and screened. The −100 mesh fraction of crushed extruded binder powder is largely fines. From about 60 to 80% of the particles are −325 mesh with corresponding apparent densities of about 2.0 to 3.3 grams per cc. Both the percentage of fines and the apparent density of this material are, however, less than those of the milled powder. It is our belief that each particle of powder in the material, as the result of blending and extruding, is coated with a film of binder, and that in the green compacts pressed from this material the powder particles are held together by this binder film.

The agglomerates of powder and binder are pressed in dies or molds of the desired shape under a pressure of about 50 tons per sq. inch, as has been mentioned. The compacting pressure can be as low as 20 tons per sq. inch or as high as 70 tons per sq. inch, the density of the green compacts being higher at higher compaction pressures. At a compaction pressure of 20 tons per sq. inch, compact density is about 56 to 58% of cast density, and at 70 tons per sq. inch it is 70 to 72% of cast density.

The desired density of the finished article is obtained by sintering the compact in vacuum or reducing atmosphere at a temperature between the solidus temperature and liquidus temperature of the alloy. Sintering can be completed in about an hour, but if the time is extended to 2 or at most 3 hours, the temperature can be reduced somewhat without impairing the properties of the article. Compacts properly sintered have densities of 98% or better of cast density.

Our invention also contemplates grinding, when necessary, of part or all of the powder particles resulting from the atomization of a melt as above described. We grind relatively coarse atomized powder, such as −30 mesh by ball milling, impact milling, attriting, vibrating milling, or other known process so as to convert it to particles more than 98% of which are −325 mesh and process those particles in the way described above to produce sintered articles having improved properties. The milling vehicle which we prefer to use is methanol, the mill is preferably evacuated to minimize oxidation of the charge, and, in the case of ball milling, the balls charged are made of a wear-resistant alloy of a composition compatible with the product being produced. Milling time ranges from about 8 to 36 hours and the average particle size of the −325 mesh product ranges from about 30 microns to as low as 9 microns, depending on milling conditions. After milling, the charge is dumped from the mill and the powder allowed to settle. The alcohol is decanted and the sludge is vacuum filtered. The powder filter cake is allowed to dry under vacuum or in air, and is then crushed to −100 mesh to break up the cake. The powder at this point is ready for addition of binder as described supra.

Compacts of −30 mesh atomized powder of Alloy No. 7 cannot be sintered. The −325 mesh fraction of this powder, which has an average particle size of about 31 microns, can be sintered, although the temperature range for 95% density is rather narrow. As has been mentioned, however, the −325 mesh fraction of the atomized powder represents only about 25% to 35% of the powder. The −30 mesh atomized powder milled to an average particle size of about 15 microns can be sintered to 95% density or better within a temperature range of about 25° to 30°. This range is broad enough for commercial operation. The oxygen content of the milled powder is about 0.44%. It is interesting to find that the addition of a relatively minor amount of a fine fraction of the atomized particles to milled powder appreciably impairs its sinterability. In another run a charge of −30 + 270 mesh atomized powder of No. 7 alloy was ground in a ball mill for 25 hours to an average particle size of about 10 microns. This material was mixed with −270 mesh atomized powder in amount representing 30% by weight of the aggregate. The average particle size of this aggregate was 23.5 microns. Compacts of the aggregate did not sinter as well as compacts of −30 + 270 mesh atomized powder milled in a ball mill for 18 hours to an average particle size of 15 microns. The first mentioned powder had to be sintered at a temperature of 2300° F. for better than an hour to achieve 95% density. Sintering at 2310° F. for an hour resulted in an article density of 98.25%. The second mentioned powder achieved a compact density of 95% after one hour of sintering at 2280° F. and 98% after 1 hour at 2290° F.

EXAMPLE I

The −325 mesh fraction of atomized powder of Alloy No. 3 of the Table was dry blended in a mixer with particles of a binder, preferably −100 mesh polyvinyl alcohol, in amounts of 2% to 3% by weight. The powder particles used had an average particle size of about 30 microns. Then enough warm water was added to form a plastic mixture of the powder and binder. This mixture was then extruded into cylinders or roundels of about 2 inches long and ½ inch in diameter under pressure sufficient to consolidate the mixture to a density of about 60% of cast density. The roundels were dried, then crushed in a roller crusher, hammer mill, or the like, and the crushed material was screened to −100 mesh. The −100 mesh agglomerates of blended alloy powder particles were formed under pressure of about 50 tons per sq. inch into green compacts of the desired shape, which had sufficient strength to withstand further processing. The green compacts were then sintered for 1 to 3 hours at a temperature of between 2260° F. and 2325° F. The binder volatilized during sintering and the sintered articles had a density of 97% to 99% of cast density.

EXAMPLE II

Inert gas atomized powder of Alloy No. 7, a nickel-base alloy, was screened through a 30 mesh screen. One hundred pounds of the screened powder were charged into a 28 inches long ball mill along with 13 gallons of methanol and about 800 pounds of HAYNES STELLITE® Alloy No. 3 balls. The mill was evacuated and run at approximately 80% of critical speed (54 r.p.m.) for 10 hours. The average particle size of the resulting powder was about 17.5 microns. About 98% of the powder was −325 mesh. The powder was removed from the mill, filtered, dried, and dry blended with 2% by weight of −100 mesh polyvinyl alcohol particles, and 1% by weight of Acrowax C, mixed with water to form a putty-like mass, extruded into roundels, dried, crushed, charged into a die, pressed and removed from the die. The coherent green compacts were placed in a sintering furnace and sintered at a temperature between 2210° F. and 2230° F. for a period of time of 1 to 3 hours. The articles resulting had a density of 98% to 99% of cast density and Rockwell C scale hardness of 41 to 44.

EXAMPLE III

Inert gas atomized powder of Alloy No. 6, which is a cobalt-base alloy, was milled as is described in Example II except for a time of 36 hours to powder having an average particle size of 11.5 microns. This powder was then processed as described above, except that 3% polyvinyl alcohol plus 1% Acrowax C constituted the binder, into coherent compacts, which were transferred to a sintering furnace and sintered at a temperature between 2140° F. and 2160° F. The finished articles had a density of 96 to 98% of cast density.

EXAMPLE IV

Inert gas atomized particles of Alloy No. 8, which is an iron-base alloy, were screened through a 325 mesh screen. The particles passing though the screen were then mixed with a binder as described in Example I, except that the binder was 3% polyvinyl alcohol, and further processed as there described into green compacts. These compacts held their shape, and were transferred to a sintering furnace and sintered at a temperature between 2150° F. and 2170° F. to articles having a density of 97% of cast density.

EXAMPLE V

Inert gas atomized particles of Alloy No. 8 of −30 mesh size were ground in a ball mill for 24 hours to particles of an average particle size of about 9 microns. These particles were then blended with 3% by weight of polyvinyl alcohol particles and 1% by weight of particles of Acrowax C and further processed as is described in Example I into coherent green compacts. Those compacts were sintered at a temperature between 2140° F. and 2170° F. to articles having a density of 97% of cast density.

The vehicle chosen for the ball milling has some effect on the sintering process. While we would prefer to use water, we find that its use results in a measurable increase in the oxygen content of the sintered article and a narrowing of the temperature range for sintering. Where the oxygen content of the alloy is critical or where the sintering range is restricted we use a solvent other than water. In the case of No. 7 alloy, for example, made from powder of about 18 microns average size, the increase in oxygen content of the alloy arising from the use of water as a vehicle is about 0.43% . We prefer to use methanol as a vehicle, which brings about an increase in oxygen content of only about 0.12%. Other organic solvents that may be used as vehicles are ketones, aromatic hydrocarbons and methane series compounds.

On the other hand, the decomposition of organic binders increases the carbon content of the sintered article in amounts between about 0.1% and 0.2%. In Alloy No. 3 and lower carbon high performance alloys known to the art, this increase can be significant, and in such cases we add to the powder small amounts of an oxide of a metal which is reduced by carbon at the sintering temperature. Cobalt oxide is suitable for Alloy No. 3 and is preferred by us. For other alloys, nickel oxide or oxides of other metals compatible with the alloy composition may be used.

Our invention is useful with powder of alloys containing a dispersed phase. We have made thereby, alloys consisting of a matrix of Alloy No. 2 having particles of tungsten carbide dispersed therein in amounts from about 25% to about 60% by weight. The tungsten carbide powder is added to the alloy powder and mechanically mixed therewith. The powder mix is then blended with a suitable binder and processed from that point on in the same way as is described in the examples above set out.

In the foregoing description of the process the screen sizes are ASTM screen sizes. Average particle sizes were determined by Sharples Micromerograph.

In the foregoing specification we have described certain presently preferred embodiments of this invention, however, it will be understood that this invention can be otherwise embodied within the scope of the following claims.

We claim:

1. A sintered powder metal article of a high performance metal alloy characterized by high density and properties equivalent or superior to those of a cast article of like alloy and produced by the steps comprising mixing alloy powder with a dry, finely divided organic binder in amounts not greater than about 5% by weight of the alloy powder so as to obtain a uniform dispersion of binder in the alloy powder, then adding a solvent for the binder in amount sufficient to form a plastic mixture with the alloy powder and binder, then consolidating the plastic mixture under pressure to a bulk density intermediate that of the powder and that of the cast alloy, then drying the consolidated mixture to evaporate the solvent, then crushing the consolidated mixture to discrete agglomerates of alloy powder particles, then filling a die of the desired shape with those agglomerates, then compacting the agglomerates in the die to at least 50% of the cast density of the alloy, so as to produce a coherent green compact, then removing the compact from the die, and then sintering the green compact at a temperature between the solidus and the liquidus temperature of the alloy.

* * * * *

UNITED STATES PATENT OFFICE

CERTIFICATE OF CORRECTION

Patent No. 4,062,678 Dated December 13, 1977

Inventor(s) Dennis G. Dreyer et al.

It is certified that error appears in the above-identified patent and that said Letters Patent are hereby corrected as shown below:

In the Table entitled "Compositions of Typical Alloys In Weight Percent Alloying Elements" in the line for Alloy 1 under V (Vanadium) delete 1.0* and move 1.0* to the B (Boron) column and also add a dash (-) beneath the S ( Sulphur) column.

In the line between Alloy 10 and 11 below Ta + Cb insert 7.0.

Signed and Sealed this

Twenty-eighth Day of March 1978

[SEAL]

Attest:

RUTH C. MASON
Attesting Officer

LUTRELLE F. PARKER
Acting Commissioner of Patents and Trademarks

UNITED STATES PATENT AND TRADEMARK OFFICE

CERTIFICATE OF CORRECTION

PATENT NO. : 4,062,678

DATED : December 13, 1977

INVENTOR(S) : Dennis G. Dreyer, Edward M. Foley and Herbert E. Rogers, Jr.

It is certified that error appears in the above-identified patent and that said Letters Patent are hereby corrected as shown below:

On the Title Page under Related U.S. Application Data, "Division of Ser. No. 443,091" should read --Division of Ser. No. 434,091--.

Column 1, line 6, "Ser. No. 443,091" should be --Ser. No. 434,091--.

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*